United States Patent [19]

Johnson

[11] Patent Number: 4,912,795

[45] Date of Patent: Apr. 3, 1990

[54] PREFABRICATED UNIT CONSTRUCTION MODULAR BRIDGING SYSTEM

[75] Inventor: John R. Johnson, St. Annes-On-Sea, England

[73] Assignee: Acrow Corporation of America, Carlstadt, N.J.

[21] Appl. No.: 240,687

[22] Filed: Sep. 6, 1988

[51] Int. Cl.[4] ..... E01D 9/02

[52] U.S. Cl. ..... 14/3; 14/4; 52/645

[58] Field of Search ..... 14/1, 3–6, 14/13–15, 24, 25; 52/223 R, 227, 640, 641, 643, 645, 646, 690, 691, 693, DIG. 10

[56] References Cited

U.S. PATENT DOCUMENTS

| | | | |
|---|---|---|---|
| 254,978 | 3/1882 | Irelan | 14/5 |
| 2,126,844 | 8/1938 | Uecker et al. | 52/691 |
| 3,062,340 | 11/1962 | Hunnebeck | 14/13 X |
| 3,587,125 | 6/1971 | McLeese | 14/6 |
| 4,706,436 | 11/1987 | Mabey et al. | 52/645 |

FOREIGN PATENT DOCUMENTS

| | | | |
|---|---|---|---|
| 2510155 | 1/1983 | France | 14/6 |
| 244280 | 4/1947 | Switzerland | 14/14 |
| 423996 | 2/1935 | United Kingdom | 14/14 |
| 553374 | 5/1943 | United Kingdom . | |
| 990412 | 4/1965 | United Kingdom | 14/14 |

*Primary Examiner*—William P. Neuder

*Assistant Examiner*—Matthew Smith

*Attorney, Agent, or Firm*—John G. Gilfillan, III; Louis S. Gillow

[57] ABSTRACT

A prefabricated modular unit construction bridging system in which all components are identical and interchangeable to meet any variation of span, width of roadway, number of lanes of traffic, and live load specification for any temporary, semi-permanent, or permanent bridge. The bridge is capable of being dismantled and the individual modular components used elsewhere to form a new bridge. The panels, when connected end-to-end to form the main load-bearing trusses of the bridge side girders, are of such a shape that they can be pinned together at their bottom chord level to support the standard cross-beams and modular deck units/bracing throughout the bridge and provide gaps between adjacent panels at their top chord level into which can be pinned other standard chord units of such a length calculated to eliminate entirely both the natural pinhole deflection inherent in 2-pinned modular truss structures and the elastic deflection under dead load. Some or all of the elastic deflection due to live load may also be eliminated. Also, the same shaped basic panels can be up-turned to form a second story of panels in double story truss constructions. The bottom chords of the up-turned panels form the top chord of each truss of the side girders, and the bottom chord of the lower panels form the bottom chord of each truss of the side girders.

6 Claims, 7 Drawing Sheets

PREFABRICATED UNIT CONSTRUCTION MODULAR BRIDGING SYSTEM

BACKGROUND OF THE INVENTION

This invention relates generally to portable unit construction modular bridging in which components are joined together on site to form a bridge of the required length and strength within the overall limitations of the system.

Examples of prefabricated unit construction modular bridging systems may be found in U.K. Patent No. 553,374 and U.S. Pat. Nos. 3,062,340 and 4,706,436. The Bailey Bridging system shown in U.K. Patent No. 553,374, used extensively throughout World War II, was one of the first and possibly the best known example. In the Bailey system, main load-bearing side girders are built up from rectangular panels (10 feet long and 4 feet 9 inches high center to center of pin-hole connections in the case of Bailey, but possibly differing in other systems) pinned or bolted end-to-end at their top and bottom chords to form a truss of the required length. Panel trusses can be placed side-by-side to form multi-truss single story side girders, and can be bolted together one on top of the other where multi-truss double story construction is required in the side girders.

It follows that any span can be built in multiples of the panel length (10 feet in the case of Bailey Bridging) and the load carrying capacity can be varied, as necessary, by using one or more trusses side-by-side in each side girder of the bridge (multi-truss single story construction) and by bolting panels one on top of the other to form side girders of twice the height and much greater moment of inertia and section modulus (multi-truss double store construction). It should be noted that in order to connect these panels together end-to-end and one on top of the other to form double story trusses, it is essential that each panel be exactly rectangular and precisely identical to the next.

One inherent fault of such 2-pinned rectangular panel bridge trusses is that when adjacent panels are pinned or bolted together at the top and bottom chord connections to form the main supporting side girders of the bridge, sag of the side girders occurs. This pin-hole sag is a function of the actual and necessary tolerance between the pin or bolt diameter and the diameter of the pin (or bolt) hole in the connecting blocks of the adjacent panels, the number of panels (and therefore panel connections) in the span of the side girder trusses, and the distance between the top and bottom chord pin-hole connections. In long span single story bridges this pin-hole sag (when added to normal elastic deflection of the structure under dead and live load) is often aesthetically unacceptable, and this may even be true of double story bridges of very long span even though the pin-hole sag is virtually half that of a single story bridge of the same span and the elastic deflection under load is also reduced due to the greater depth (and increased moment of inertia) of the side girders.

Where such existing 2-pinned rectangular panel bridging systems are required to take heavY loads over long spans, it is usually necessary to increase the bending moment capacity and reduce the deflection of each side girder by bolting the bottom chord of a second row of panels on top of the top chord of the lower row of panels in each truss, as previously described. This form of construction of existing modular bridging has the disadvantage of placing a considerable area of steel (the top chord of the bottom panels and the bottom chord of the top panels) at or near the neutral axis of each truss (which within the context of this patent application can be defined as that horizontal line running through the centroid to the [vertical] cross-section of each truss), and in the majority of cases this superfluous steel merely adds to the dead weight of the bridge and correspondingly detracts from its live load capacity.

Longitudinal forces (due to traction etc.) on the roadway of any through-type bridge must be transmitted from the deck units through the supporting cross-beams (transoms) and the load-bearing side girders to the abutments. In many existing designs of modular truss bridges, the attachment of cross-members (transoms) to the individual panel diagonal/vertical members and bottom chord members causes some rotational forces and residual local bending stresses in one or more of these members. Such effects are detrimental in that they detract from the ability of the diagonal/vertical members and bottom chord members of side panels to withstand the direct compression and tension due to the normal vertical dead and live loads on the bridge.

SUMMARY OF THE INVENTION

In particular, the invention relates to the elimination or reduction of pin-hole sag and elastic deflection of such modular bridging where identical prefabricated panels are pinned or bolted together end-to-end to form a truss of the required span, with such trusses linked together on either size of the bridge to form the main load bearing girders of the bridge; to the elimination of unnecessary steel at the neutral axis of the main load bearing girders of the bridge in double story construction; to the near-elimination of local bending stresses at the connection between cross-members (transoms) and the diagonal and bottom chord members of panels of the main load bearing girders of the bridge; and to the provision of temporary struts bolted into the triangular modules of the panels of the main girders of the bridge were necessary during the launching of the bridge into position over roller assemblies.

The unit construction modular bridging system of the present invention is especially useful for all highway loadings for spans ranging between 20 feet and 300 feet in increments of 10 feet, and provides roadways widths of single, double, and triple lane highway specifications using multiples of the same three types of decking units in all cases. The bridging is also capable of taking all kinds of construction plant and equipment for which special heavy duty decking units and cross-support members (transoms) can be provided, if necessary. All components of the bridging system are prefabricated with similar components being interchangeable and replaceable, transportable in standard trucks or containers, simply erected, easily dismantled, and re-usable elsewhere.

The overall objective of the present invention is to provide a prefabricated modular unit construction bridging system whereby all similar components are identical and interchangeable, so that such components may be assembled in the required quantities and configuration to meet any variation of span, width of roadway, number of lanes of traffic, and live load specification for any temporary, semi-permanent, or permanent bridge which falls within the scope of the system. Such bridges are capable of being dismantled and the individual modular components used elsewhere, with or without additional similar components as may be necessary, to form a new bridge of the same or different span and/or roadway width, number of lanes, and loading conditions. All components are simple to erect, easy to construct, and capable of transportation on standard trucks and in standard containers.

A specific object of the present invention is to provide a modular bridging system whereby the panels are, when connected end-to-end to form the main load-bearing trusses of the bridge side girders, of such a shape that they can be pinned together at their bottom chord level to support the standard cross-beams and modular deck units/bracing throughout the bridge and provide gaps between adjacent panels at their top chord level into which can be pinned other standard chord units of such a length calculated to eliminate entirely both the natural pin-hole deflection inherent in 2-pinned modular truss structures and the elastic deflection under dead load. Some or all of the elastic deflection due to live load may also be eliminated if so required.

A further object of one form of the present invention is that precisely the same shaped basic panels can be up-turned to form a second story of panels in double story truss constructions (when required for greater spans and/or greater load carrying capacity), the short top chords of the up-turned upper story panels fitting precisely into the gaps between the short top chords of the lower story of panels to which they are pinned to form a continuous single chord at the neutral axis of each of the double story trusses of side girders. The bottom chords of the up-turned panels form the top chord of each truss of the side girders, and the bottom chord of the lower panels form the bottom chord of each truss of the side girders.

An ancillary effect of this form of the invention is that the area of steel used in the single continuous chord formed at the neutral axis of the trusses when upper and lower story panels are pinned together in double story side girder construction is approximately one half of the area of steel at the neutral axis when two rectangular panels are bolted together one on top of the other to form the double story side girder construction. This reduction in superfluous steel within the side girders reduces the dead weight of the structure and therefore increase the live load capacity of the structure correspondingly.

Even though the preferred form of the invention is as mentioned above, it is still possible to bolt one panel directly above the other in double story construction, thus giving a double chord at the neutral axis, provided that such construction is advantageous to, or at least does not detract from, the overall efficiency and loading requirement of the bridge. In this instance, standard chord members are inserted into the gaps both between the top chords of the lower story of panels and the top chords of the upper story of panels, thus forming a continuous double chord at the neutral axis of the double story trusses of the side girders as well as a continuous single truss top chord.

In either form of double story truss construction, although the pinhole deflection and elastic deflection due to dead load are not eliminated (as is the case for single story construction) nevertheless the shape, length, and height of panels are such that for any given span of the bridge, the number of pin joints in the top and bottom chords is much less than for rectangular Bailey type panels of similar proportions and configuration. As a result the pin-hole deflection of the side girders is considerably reduced.

Roadway supporting cross-members (transoms supporting the dead and live loads carried by the complete decking structure) are located on dowels above the intersections of panel bottom chords with panel diagonal members, and are prevented from rotation (due to traction and other longitudinal forces on deck members) by being bolted to the bottom gusset plates of these diagonal members. The design of the invention thus ensures that all superimposed deck loads are transferred directly into the panel truss members of main side girders, and impose no local bending stresses in the bottom chord or diagonal members of panels.

A requirement of most modular bridging systems is that they should be capable of being launched into position over temporary roller assemblies, and these rollers inevitably induce high local bending stresses in the bottom chords of panels as the knife-edged roller loads pass under them between panel truss supporting nodes. This effect is minimized by yet another ancilliary embodiment of the invention whereby a temporary strut is bolted between the mid-point of the bottom chord of any triangular module of the truss panels and the node immediately above it, as the rollers pass beneath that particular section of the bottom chord. These struts are progressively moved from one triangular module to the next (in those bays only where the roller loads on the bottom chord exceed the capacity of the bottom chord itself) as the bridge is launched forward over the roller assemblies. Both the temporary struts and the roller assemblies are removable after launch for use elsewhere.

DRAWINGS

The objects and advantages of the present invention will be apparent from the following detailed description of preferred embodiments thereof and the attached drawings of which:

DESCRIPTION OF PREFERRED EMBODIMENTS

Figure 1:
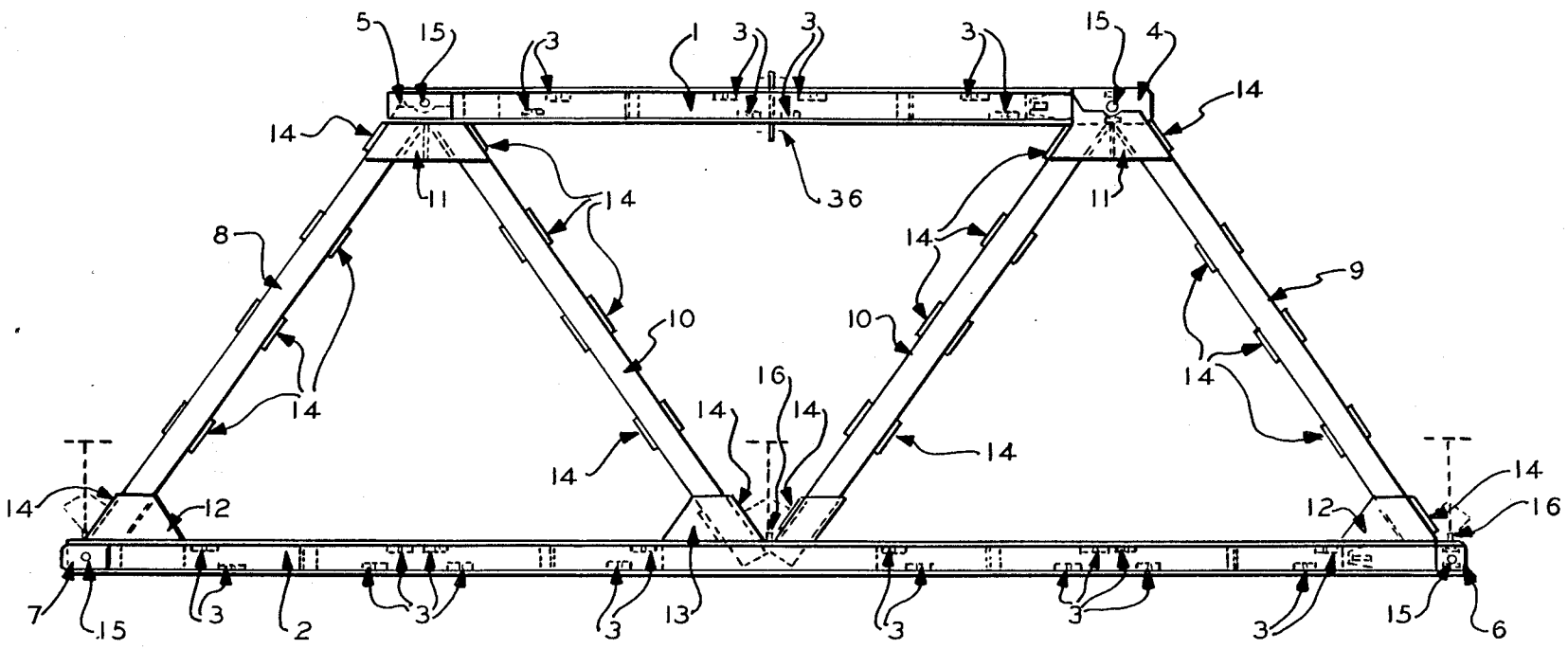
FIG. 1 is a side elevation of a typical basic panel used to construct any truss of the main load-bearing side girders of a bridge made up from the prefabricated standard modular components of the invented system.

As shown in FIG. 1 one embodiment of the prefabricated, unit construction, modular bridging system relating to the present invention is its basic standard trapezoidal panels used to construct any truss of the main load-bearing side girders of the prefabricated bridge. These panels are of such dimensions and weight (as are all other standard components used in the bridging system) that they are easily handleable by any small mobile crane and transportable to site in standard trucks and containers.

Figure 4:
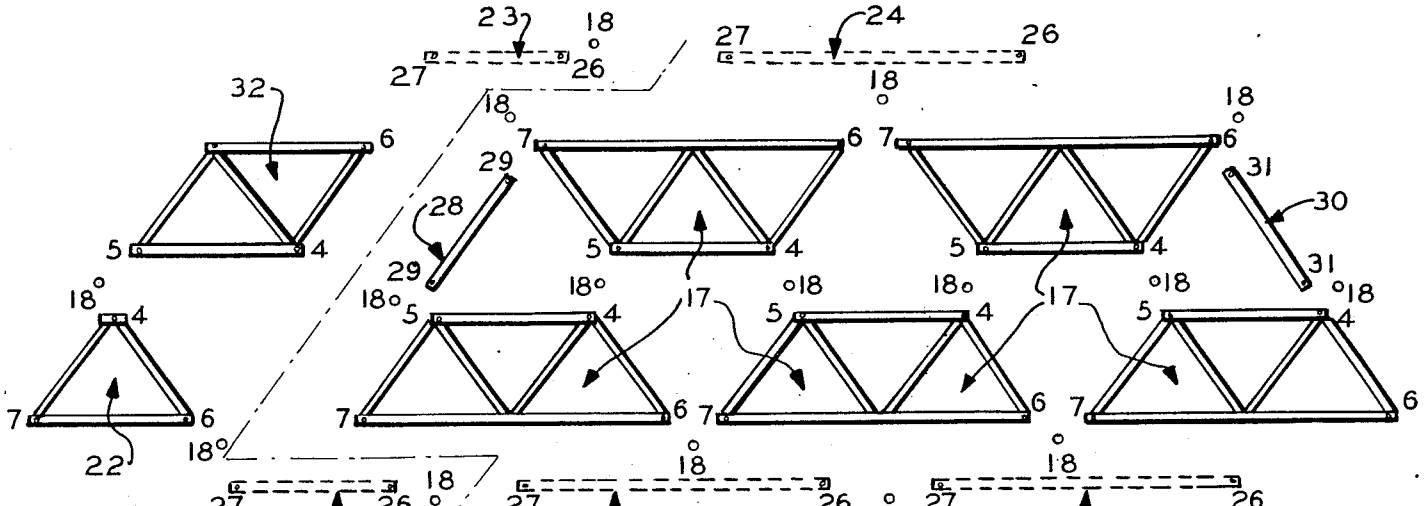
FIG. 4 is an exploded side elevation of a double story panel truss of a side girder of a typical bridge with a single chord only at the neutral axis of the truss showing the main components used.
Figure 5:
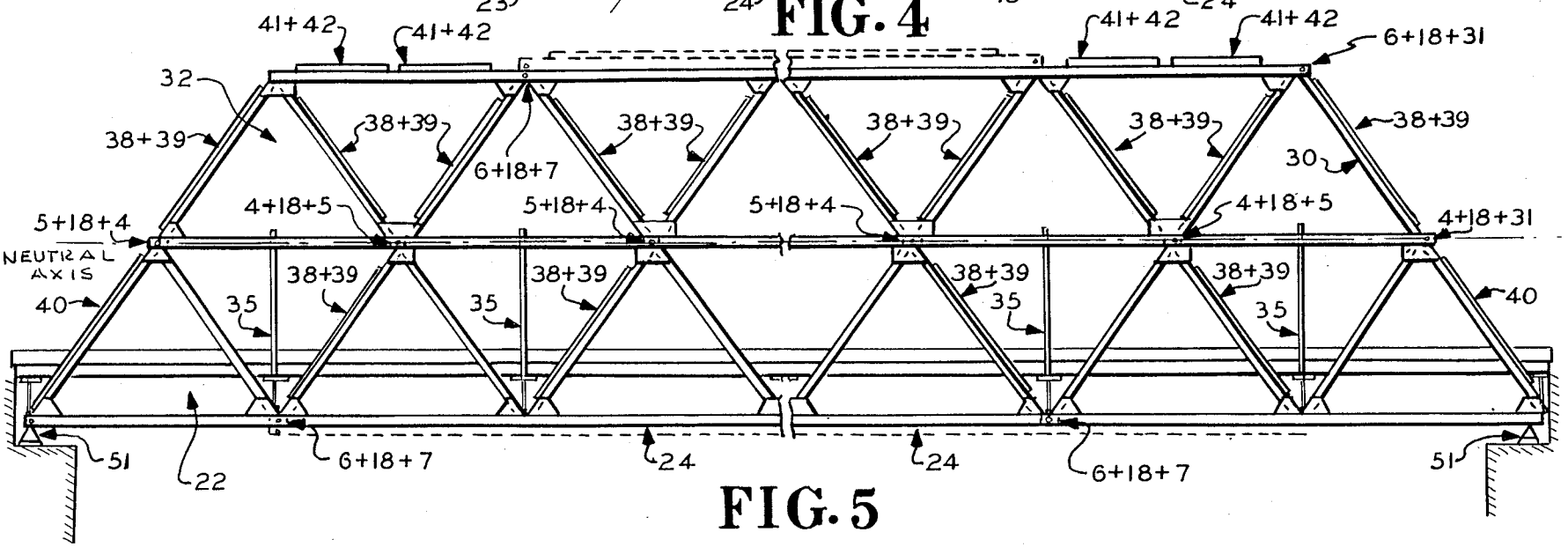
FIG. 5 is a split side elevation of a typical double story bridge span, with a single chord only at the neutral axis of the truss.
Figure 6:
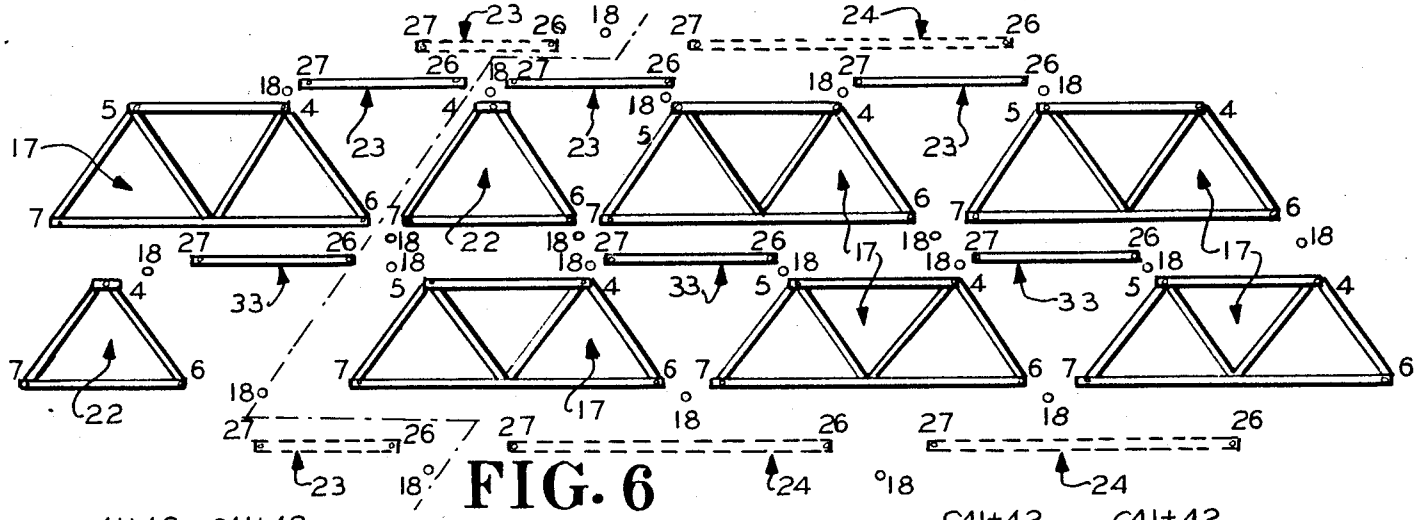
FIG. 6 is an exploded side elevation of a double story panel truss of a side girder of a typical bridge, where one row of panels is bolted directly on top of the other thus forming a double chord at the neutral axis of the truss, showing the main components used.
Figure 7:
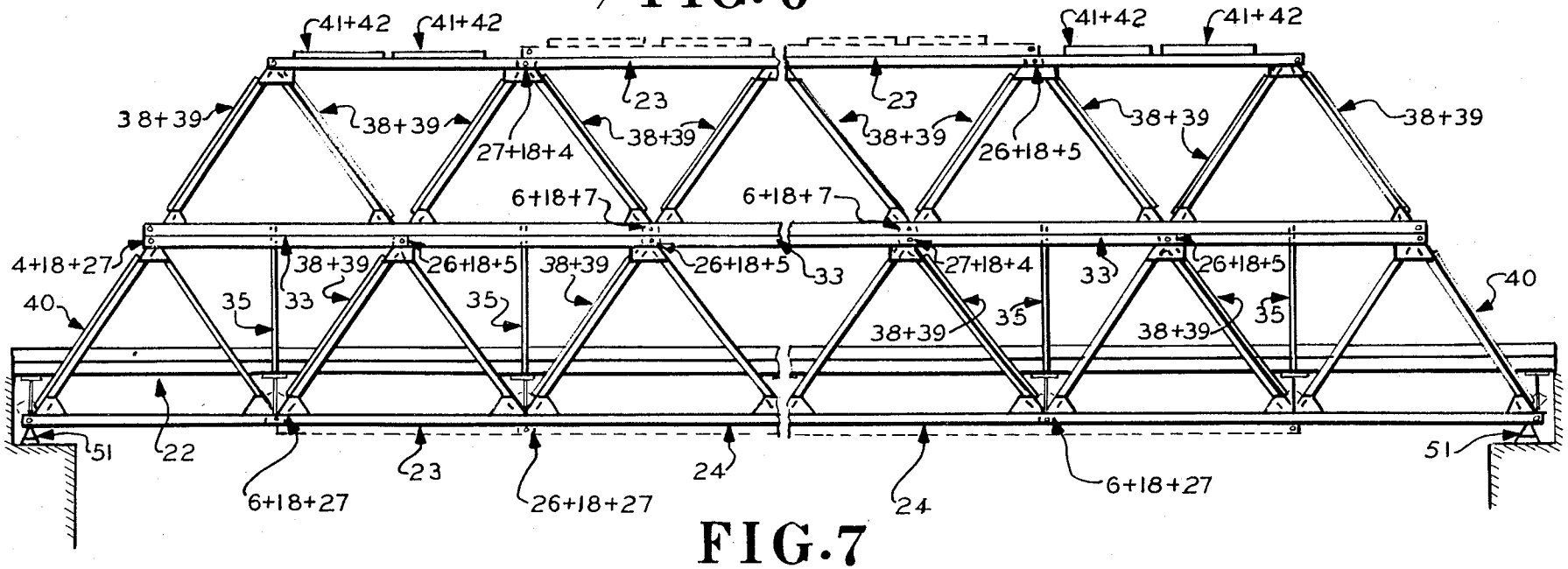
FIG. 7 is a split side elevation of a typical double story bridge span, with a double chord at the neutral axis of the truss.
Figure 11:
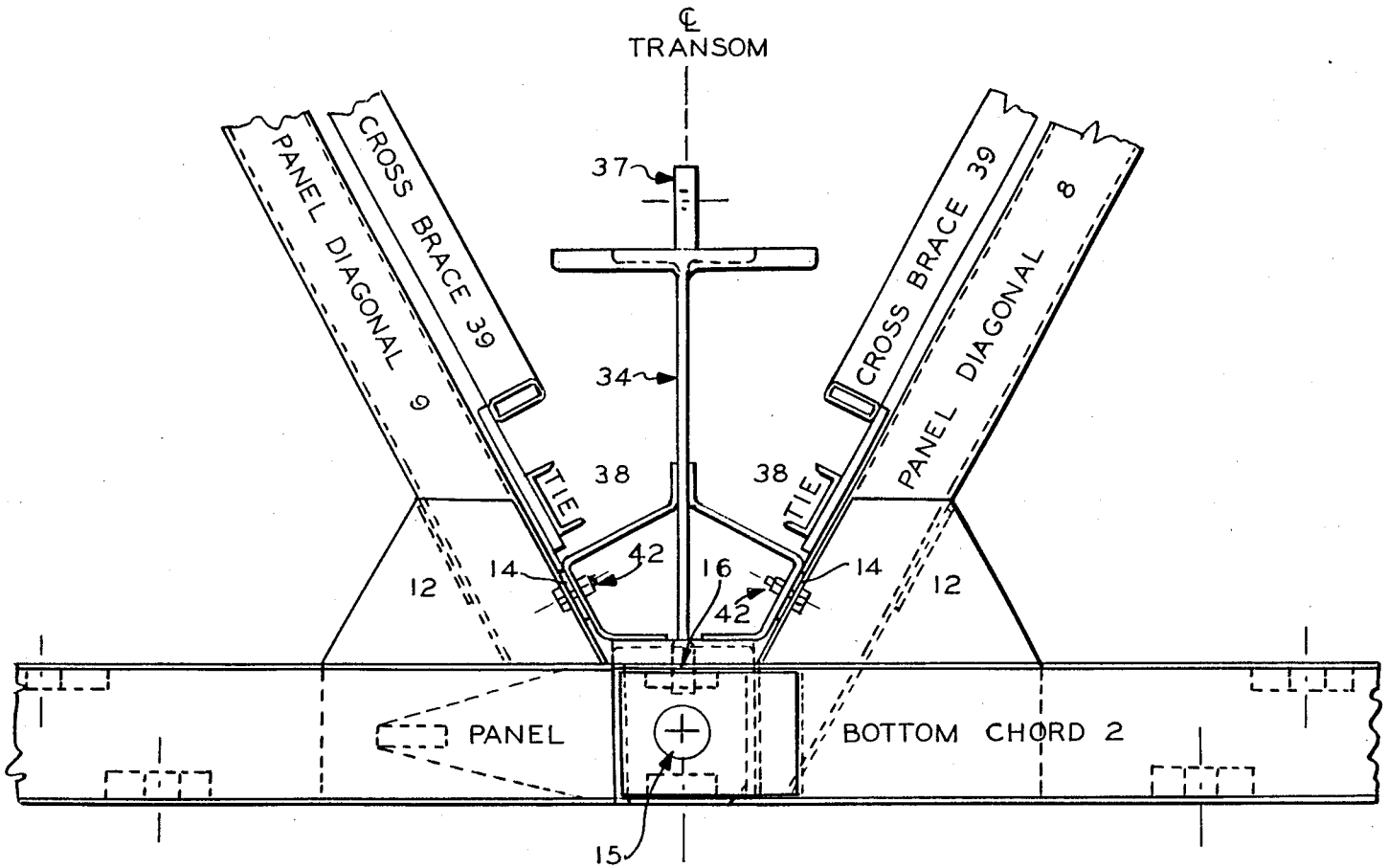
FIG. 11 is an enlarged detail of the location and fixing of the end of a cross-beam (transom) to a truss panel at the intersection of diagonal members with bottom chord members.

The top chord of each panel is preferably of two sections back-to-back spaced apart by drilled spacer blocks 3 which allow panel trusses to be bolted together side-by-side by standard bracing components (in multi-truss single story construction) or one on top of the other (in multi-truss double story construction), or which allow the attachment of reinforcing chords to increase the bending moment capacity of the side trusses if required. At one end of the top chord drilled blocks 4 are welded between the two back-to-back sections to form a male panel connecting lug, and at the other end of the top chord drilled blocks 5 are welded to the outer web faces of the two back-to-back sections to form a corresponding female panel connecting jaw. The bottom chord 2 is also preferably of the same two sections back-to-back spaced apart by drilled spacer blocks 3 which allow panel trusses to be bolted together side-by-side by standard horizontal bracing components or the attachment of reinforcing chords where the top story panels are up-turned in multi-truss double story construction with a single chord at the neutral axis as shown in FIGS. 4 and 5. In multi-truss double story construction with a double chord at the neutral axis as shown in FIGS. 6 and 7, the bottom chord 2 of the upper panels is bolted directly through the spacer blocks 3 to the upper chord 1 of a lower panel and an intermediate member 33 pinned between the top chords of adjacent panels. Drilled blocks 6 and 7 form a male panel connecting lug and a female panel connecting jaw, respectively, at the same ends of the panel bottom chord as those in the top chord, and the top and bottom chords 1 and 2 of the panel are connected to diagonal members 8, 9 and 10 (which take the shear forces in the panel) by means of suitably shaped gusset plates 11, 12, and 13. Once again, diagonals are preferably of two sections so spaced apart that their outer web faces are welded to one side of the gusset plates 11, 12, and 13 and the other faces of the latter gusset plates are welded to the webs of the sections forming either the top or bottom chords 1 or 2 of the panel. Each section in a diagonal is held apart from the other by welded gusset plates 14 of which the top and bottom plates are drilled to allow panel trusses to be bolted together side-by-side by standard strut and tie components in multi-truss construction as exemplified in FIGS. 8, 9 and 10. The bottom gusset plates 14 are also drilled to allow the attachment of bridge cross-beams (transoms) as shown in FIG. 11.

The shape of the panel is preferably trapezoidal with top and bottom chords parallel to one another and the four diagonal members forming two identical isosceles triangles with a third identical isosceles triangle upturned between them. The top chord is necessarily one half of the length of the bottom chord between the centers of end connecting holes 15 in the male lugs and female jaws. It follows that the roadway deck supporting cross-beams (transoms) (which are located on dowels 16 positioned at the center of each triangular module formed by adjacent diagonals and the bottom chord of the panels, and bolted to the bottom diagonal gusset plates 14 on either side of the dowel as shown in FIG. 11) are thus positioned at regular intervals throughout the length of the bridge.

Figure 2:
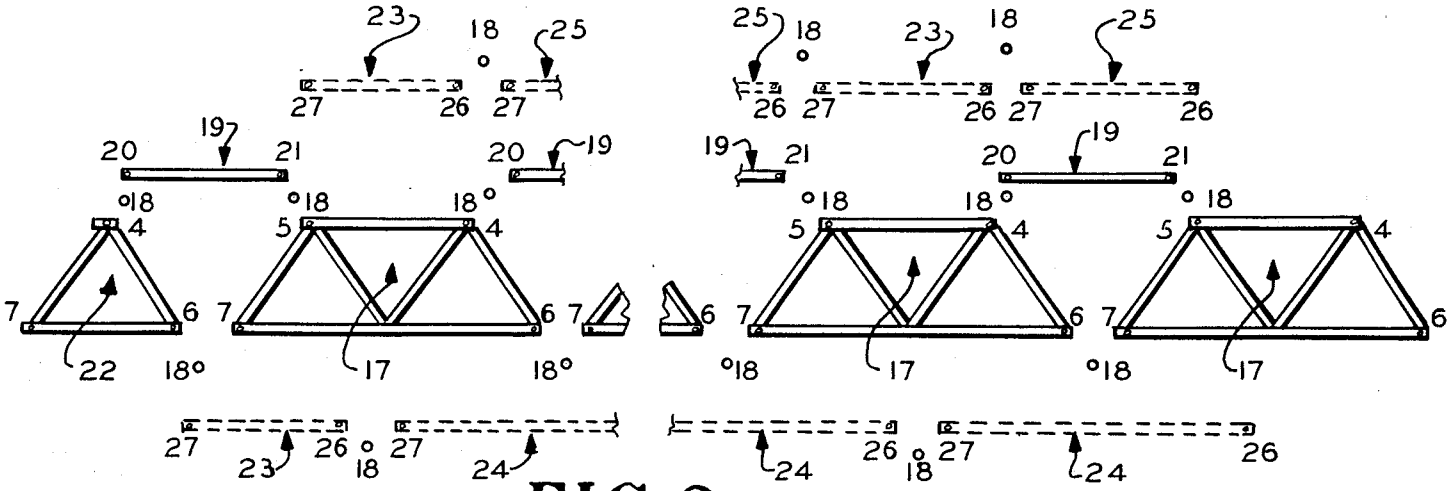
FIG. 2 is an exploded split side elevation of a single story panel truss of a side girder of a typical bridge, showing the main components used.

Within the embodiment of the design invention any single story truss of a main load-bearing side girder of the bridge is seen to be made up of standard prefabricated components connected together. These truss components are shown in an exploded elevation in FIG. 2 and connected together to form the required bridge truss in FIG. 3. Whole panels 17 as previously described and shown in FIG. 1 are directly connected together at the bottom chord level by inserting pins or bolts 18 into the connecting holes 15 of the bottom chord male lug 6 of one panel and the female jaws 7 of the adjacent panel. The top chord of the single story truss is then made up by similarly pinning or bolting the female jaw end 20 of a standard intermediate top chord member 19 (prefabricated from the same sections as a panel top chord) over the male lug end 4 of the previous panel, and the male lug end 21 of the intermediate top chord member 19 into the female jaw end 5 of the next panel. One aspect of the invention is that the standard intermediate top chord member 19 is of such a length center-to-center of end connecting holes that when it is connected between the top chords of adjacent panels it creates a "hog" in the bridge calculated to eliminate the pin-hole sag (which is due to the tolerance between the diameter of the pin-hole and the connecting pin, and is an inherent fault in trusses containing only prefabricated rectangular modular panels linked together by single-pinned connections to form the main load-bearing girders of the bridge). In addition, the length of the standard intermediate members 19 inserted between panels in the top chord can be such as to create a further "hog" in the bridge which would virtually eliminate the elastic deformation of the bridge due to dead load at average span and maximum stress conditions. Therefore, it is evident that the members 19 may be made slightly longer than the length of the top chords of the panels 17, thereby permitting the bottom cords to form an arched line sufficient to compensate for any sag or deflection.

A half panel 22 (with either a male or female top connector) can be added at one end of a panel truss, pinned to the bottom chord of the adjacent standard panel and to a standard intermediate member 19 to form the top chord. Thus it is possible to vary the length of each panel truss of the main load-bearing side girders of the bridge from as little as one panel length to the maximum permissible length (consistent with the strength of the bridge girder construction) in increments of triangular "half-panel" modules.

Additionally, the load carrying capacity of a bridge truss can be augmented by the attachment of chord reinforcements (shown in hatched lines in FIGS. 2 and 3) to the top and bottom chords of one or more bridge trusses in each side girder. Each standard chord reinforcement is preferably made up of two sections back-to-back spaced apart by drilled spacer blocks 3, with a male lug 26 at one end and a female jaw 27 at the other. These chord reinforcements are bolted to the truss top and bottom through the drilled spacer blocks 3 and are connected together end-to-end by inserting pins or bolts 18 through the lug/jaw connections, the strength of the pins or bolts being consistent with the strength of the chord reinforcements (which themselves can be of light or heavy sections so as to give a greater range of load carrying capacity for each reinforced truss chord). The total length of the top and bottom chord reinforcements is made up from an appropriate number of three different standard types whose lengths center-to-center of end connecting holes correspond to the lengths of a standard bottom panel chord 24, a standard top panel chord 23 and a standard intermediate top chord member 25, respectively.

Any double story truss of a main load-bearing side girder of the bridge can be made up from a number of standard fabricated components as seen in FIGS. 4 and 5. These truss components are shown in an exploded elevation in FIG. 4, and connected together to form the required span of bridge truss in FIG. 5. Panels as previously described and shown in FIG. 1 are connected together to form the bottom story of the truss by inserting pins or bolts 18 into the connecting holes 15 of the bottom chord male lugs 6 of one panel to the female jaws 7 of the next panel, et seq. Within the embodiment of the design invention, the second story in each truss is formed from standard panels up-turned so that their short top chords 1 are inserted into the gaps between the short top chords of the lower story of panels. The male lugs 4 of the lower story of panels fit into the female jaws 5 of the upper story of panels and vice versa, and all mutual connections are pinned or bolted 18. In this way the top chords of both the upper and lower storys of panels form one continuous chord at the neutral axis of each panel truss in the side girders. The bottom chord 2 of the upper (up-turned) story of panels are connected together, male to female and female to male, by pins or bolts 18 to form the top chord of each truss of the side girders as shown in FIGS. 4 and 5. In addition, in order to complete each truss frame a standard male end diagonal member 28 is connected between the top and bottom story panels by pins or bolts 18, the male lugs 29 of the male diagonal 28 being connected between the female jaws 5 of the top chord of the lower panel and the female jaw 7 of the bottom chord of the up-turned upper panel at one end of the bridge truss (as shown towards the left of FIG. 4). At the other end of the truss the female jaws 31 of a standard female diagonal 30 are connected over the male lug 4 of the top chord of the loWer panel and the male lug 6 of the bottom chord of the upper (up-turned) panel (as shown on the right of FIG. 4).

It is possible to extend the total length of each truss of the side girders in double story bridges as in single story bridges, if so required, by adding a further half panel 22 (with male top chord connector) into the bottom story of panels at the appropriate end of truss (see the left hand end of FIG. 4), eliminating the male diagonal 28 in the top story of panels (shown towards the left hand end of FIG. 4) and replacing it with a parallelogram panel 32 in the same position.

Since standard panels form the upper and lower storys of double story truss construction and the top and bottom chord lengths of each complete truss are therefore identical, pin-hole deflection of the truss is not eliminated in this case. However, the trapezoidal shape of each basic panel ensures that for a given span of bridge the number of pinned or bolted joints in the top and bottom chords of each double story construction is only one half of the number of joints that occur in the center chord of the bridge truss. It follows that the pin-hole deflection or sag of each truss structure is considerably reduced compared to trusses made up of rectangular panels either equal in length to the top (short) chord of the trapezoidal panels of the invention or of the same overall height as the latter panels but with their length intermediate between the top and bottom chord lengths of the trapezoidal panel (as would be necessary to maintain a sensible structural proportionality of members within the frame).

Another embodiment within the design of double story trusses as depicted in the invention in FIGS. 4 and 5 is that the area of steel used in the single continuous chord formed at the neutral axis of each truss by the top chords of the lower story of panels and the top chords of the up-turned upper story of panels is one half of the area of steel at the neutral axis of trusses formed by bolting together rectangular panels of the same proportions one on top of the other to form the double story side girder construction. This reduction in superfluous steel within the side girders reduces the dead weight of the structure and therefore increases the live load capacity of the structure correspondingly. Due to their instability when used as single trusses, double story panel trusses are used only in multi-truss construction, where all trusses in each side girder of the bridge are suitably braced together both horizontally on the top chords and/or within the height of the trusses on diagonal members.

In contrast to the preferred single chord at the neutral axis in double story construction just described above, nevertheless a further feature of the design invention is that the same standard panels and other standard components can be used to form panel trusses of double story side girders with a double chord at the neutral axis, in the occasional circumstances where such construction is advantageous to the overall efficiency and loading requirements of the bridge. These truss components are shown in exploded elevation in FIG. 6 and connected together to form the required bridge truss in FIG. 7. In this instance, the bottom story of panels is constructed in exactly the same way as a single story truss but with intermediate top chord members 33 of precisely the same length as the top chord 1 of standard panels (as against the slightly longer intermediate top chord members 19 used in single story trusses to create a "hog" in the bridge). The top story panels are connected directly to the lower story panels and standard intermediate top chord members 33 by bolting through the drilled spacer blocks 3 in the bottom chord of top story panels to the spacer blocks 3 in the top chord of the bottom story of panels and the intermediate members 33. The trusses are then completed by inserting intermediate top chord members 23 in the gaps between the top chords of the top story panels, and a half panel 22 (with male top chord connector) at one end of the upper story (as shown towards the left of FIG. 6). Again it is possible to extend the total length of each truss of the side girders in this form of double story bridges (with double chords at the neutral axis of the trusses) if so required by adding a further half panel 22 (with male top chord connectors) into the bottom story of panels at the appropriate end of the truss, eliminating the half panel 22 in the top story of panels, and replacing the latter with a standard panel 17 (see the left had side of FIG. 6).

As with single story bridges, it is possible (if so required) to augment the load carrying capacity of double story bridge trusses by the attachment of chord reinforcement (shown by hatched lines in FIGS. 4, 5, 6 and 7) to the top chord of the upper story of panels of one or more bridge trusses in each side girder and to the bottom of the lower story of these trusses. Each chord reinforcement is as previously defined in single story truss construction, and these chord reinforcements are bolted to the top and bottom chords through the drilled spacer blocks 3 and are connected together end-to-end by inserting pins or bolts 18 through the lug/jaw connections 26 and 27, the strength of the pins and bolts being consistent with the strength of the chord reinforcements (which themselves can be of light or heavy sections so as to give a greater range of load carrying capacity for each reinforced truss chord). The required lengths of the top and bottom chord reinforcements in double story trusses are made up from the appropriate number of two types of standard components, one equal to the length of a standard panel top chord (23 shown in FIGS. 4 and 6 and the other equal to the length of a standard panel bottom chord (shown as 24 in FIGS. 4 and 6).

Figures 8, 9, 10:
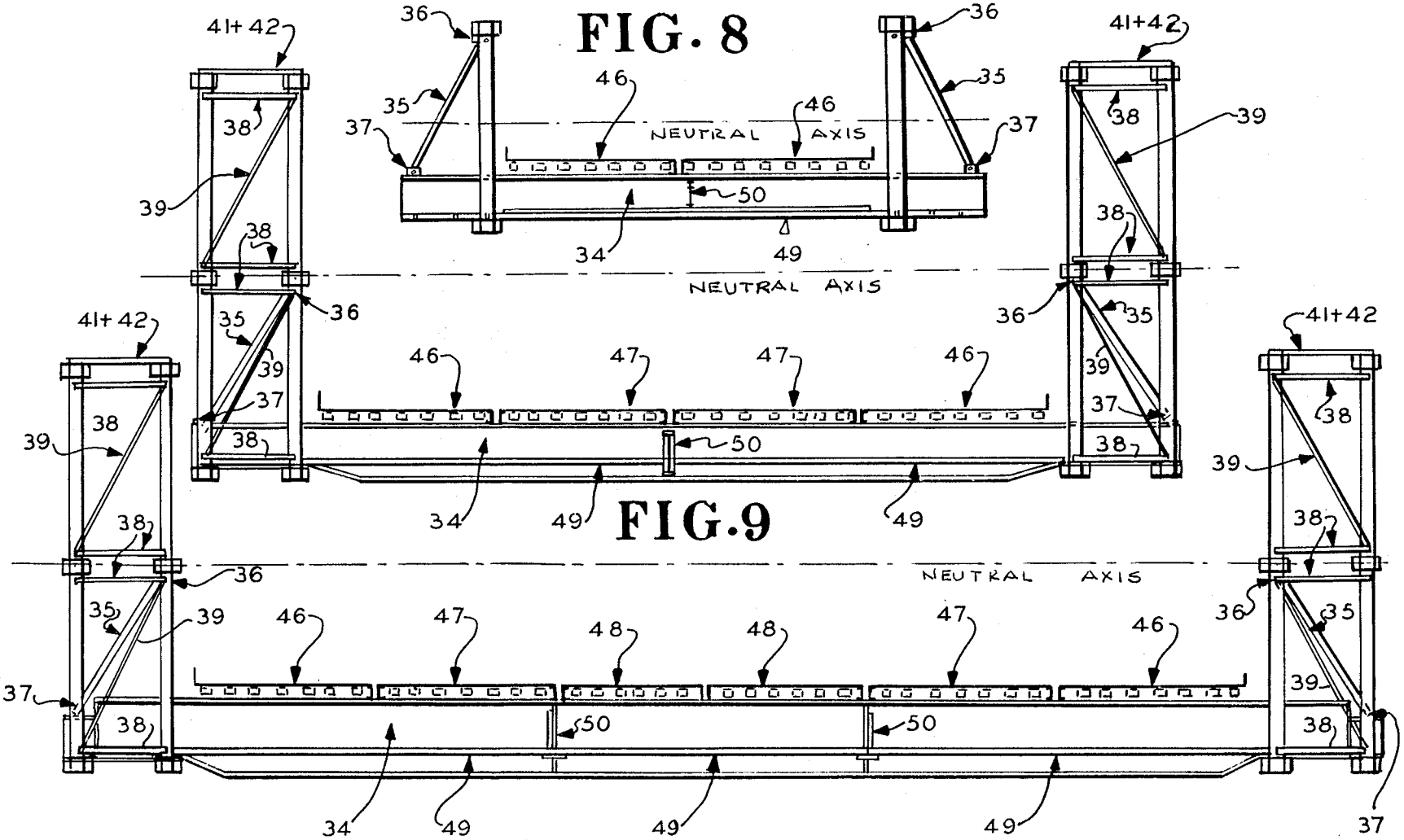
FIG. 8 is a cross-section of a typical single lane, single story bridge using only one truss in each main load-bearing side girder of the bridge.
FIG. 9 is a cross-section of a typical double lane, double story bridge using more than one truss in each main load-bearing side girder of the bridge.
FIG. 10 is a cross-section of a typical triple lane, double story bridge using more than one truss in each main load-bearing side girder of the bridge.

As shown in FIGS. 8, 9, and 10 the whole of the live and dead loads of the roadway decking system are supported on transoms 34 which are located on dowels 16 protruding from the spacers at the intersection of the panel bottom chord with the panel diagonal members in every truss of each side girder (see FIG. 11). An embodiment of the design invention is that these transoms, when located over a dowel in each panel truss in each side girder as indicated in FIG. 11, are prevented from rotation (due to the tractional and other longitudinal forces caused by vehicles travelling on the roadway deck members of the bridge) by being bolted 42 to the bottom gusset plates 14 of the panel diagonal members, which in turn dissipate these forces through the diagonal/bottom chord gusset plates 12 or 13 directly into panel members at the nodes of the trusses of the side girders, without inducing unacceptable local bending stresses within the actual bottom chord and diagonal members of the panels.

Figure 3:
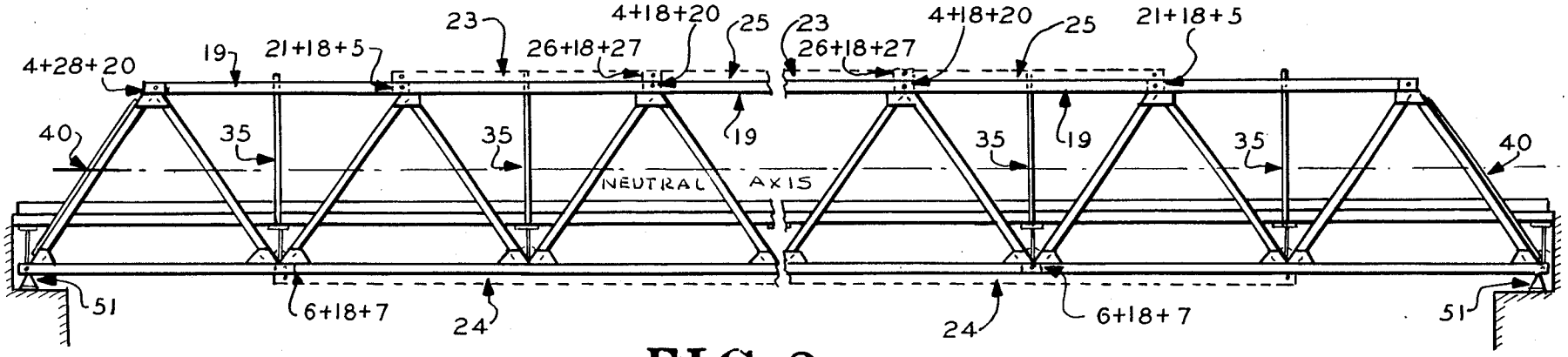
FIG. 3 is a split side elevation of a typical single story bridge span.

The verticality and rigidity of the connection between the trusses of side girders and cross transoms in single truss construction is maintained by means of standard raker members 35 bolted at the upper end to the central plate 36 in each panel or intermediate top chord member 19, and at the lower end to the lugs 37 welded to either end of the upper flange of the transom 34. These rakers are shown in FIGS. 3 and 8, together with end-of-bridge bracing members 40 in FIG. 3.

In multi-truss single story bridges, the rakers 35 are used in each triangular module of the panels, bolted between the central plate 36 in the panel top chord (or intermediate top chord member 19) of the inner truss only of each side girder and the transom lug 37, as before. All other panel trusses within each side girder are rigidly fixed to the inner trusses by means of ties 38 and diagonal braces 39 bolted to the gusset plates of the diagonal members of every truss in each side girder.

In multi-truss double story bridges precisely the same form of attachment is used as in single story bridges, except that additional ties 38 and braces 39 are bolted to the diagonals of top story panels and other ties 41 and braces 42 are bolted horizontally on top of the upper chords of the top story of panels. These bracing members are indicated on FIGS. 5, 7, 9, and 10.

A requirement of most unit construction modular bridging systems is that they should be capable of being constructed and launched into position on rollers, using a skeleton nose of standard truss and cross bracing components. The knife-edged loads imposed by the rollers during the launching of long span bridges inevitably induce high local bending stresses in the bottom chords of panels as the rollers pass under them between consecutive panel chord/diagonal intersections or nodes.

Figure 12:
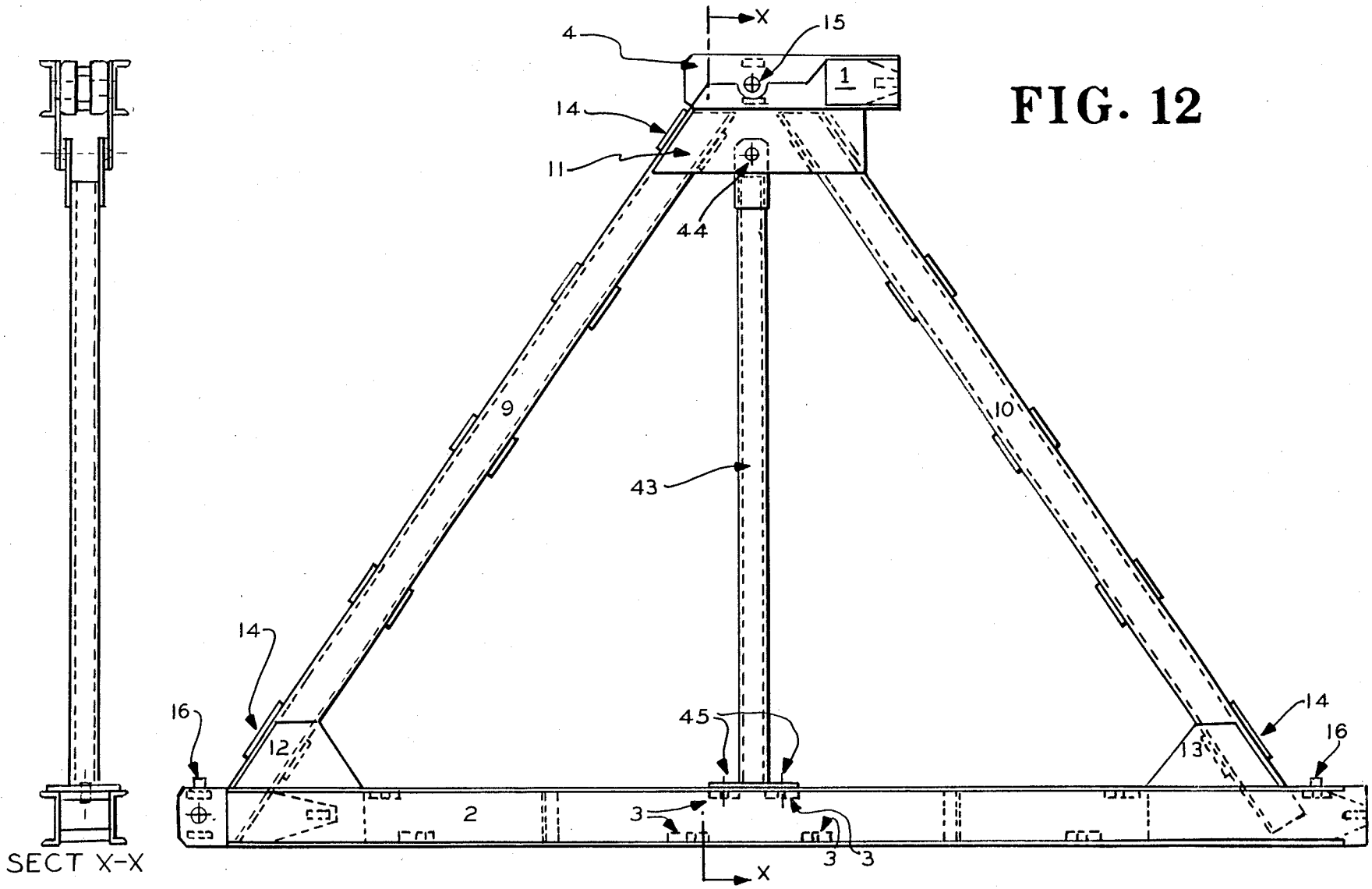
FIG. 12 is an enlarged detail of one triangular module of a side girder truss panel, showing the location and fixing of a temporary strut used during the launching of the bridge into position over roller assemblies.

This effect is minimize by yet another embodiment of the invention whereby temporary struts can be inserted into those triangular modules of each truss panel where the roller loads will exceed the capacity of the bottom chord as the bridge is launched forward over the roller assemblies. The temporary struts 43, as seen in FIG. 12, are bolted at their top end 44 to the gusset plates 11 at the apex of each triangular module of each relevant truss panel (i.e. at the junction of diagonals with panel top chord members) and at their bottom end 45 to the bottom chord spacer blocks 3. In this way the unsupported spans of the bottom chords of the relevant panels are effectively halved, thus considerably reducing local bending stresses as the rollers pass underneath, and the compressive force in the temporary struts 43 is dissipated through the top gusset plates 11 at the top chord-/diagonals intersection of panels directly into the truss frame members in the normal manner. Both the temporary struts (where used) and the launching rollers are recoverable for re-use elsewhere after the completed launch and jacking down to abutment bearings of the bridge.

The overall objective of the invention is to provide a prefabricated modular unit construction bridging system the trapezoidal shaped panels of which embody all the improvements that have already been described, compared to existing modular systems of rectangular panels, pinned or bolted together end-to-end and, where required, one on top of the other. Cross transoms 34 can be varied in width to take one, two, or three lanes of traffic and in strength to take standard or heavy highway loadings or construction plant and equipment, the ends of the transoms (which are located on dowels 16 at the intersection of bottom chord/diagonal members of truss panels) being of constant height between top and bottom flanges (see FIGS. 8,9, and 10) in order that rakers 35 supporting the inner trusses of each main load-bearing side girder of the bridge can be of standard length for all types of transoms and constructions used. Standard curb and deck units are of constant length spanning between transoms placed at the intersections of the bottom chords with diagonal members of panels, with other standard but slightly longer deck units being used in end bays of the bridge in order to span onto the abutments. Various arrangements of the three standard types of deck units 46, 47, and 48 (each of which varies in width and/or incorporates a curb angle) can be placed side-by-side and bolted to appropriate transoms 34 to give single, double, or triple lane roadway widths, which are depicted in FIGS. 8, 9, and 10. respectively. The whole bridge and deck system is braced horizontally at side girder truss bottom chord level by cross bracings 49 (which themselves are available in different standard widths, dependent on the number of lanes of traffic) and vertically by bracings and ties 50. Side girders and cross transoms are held perpendicular to one another by rakers 35, and individual trusses within multi-truss side girders are fully braced along panel diagonals for single and double story constructions by ties and bracings 38 and 39, and by additional top chord horizontal ties and bracings 41 and 42 in the case of double story constructions only, as previously described. Each bridge truss is supported at its ends on bearings 51 at the abutments to form the complete load-bearing side girder spans of the bridge (see FIGS. 3, 5, and 7).

All similar prefabricated components are identical and interchangeable so that such components may be assembled in the required quantities to meet the specifications of any temporary, semi-permanent, or permanent bridge span. The incorporation of a special trapezoidal panel and other specific features within the present invention to eliminate or greatly reduce panel truss pin-hole sag and dead load deflection, reduce the weight of the bridge by eliminating superfluous steel at the neutral axis of side girder trusses as far as possible, improve the fixation to panels of the cross transoms which support the roadway, and reduce local bending stresses in the bottom chord of truss panels during launching into position of the bridge over roller assemblies, greatly enhances the live load carrying capacity and/or permissible spans as well as other aspects of the performance of the bridge system compared to other unit construction modular bridge systems using rectangular truss panels of similar proportions and material specifications.

Obviously many modifications and variations of the present invention are possible in the light of the above teachings. It is therefore to be understood that, within the scope of the appended claims, the invention may be practiced otherwise then as specifically described.

What is claimed is:

1. A modular bridge truss comprising:

a truss formed from a plurality of interconnected congruent panels having a neutral axis of zero stress when said truss is deflected;

each said panel having parallel, top and bottom chords with said top chord being substantially half the length of said bottom chord;

each said panel having first and second outer diagonal chords of equal length with the ends thereof rigidly connected to the ends of said top and bottom chords to form said panel into the shape of an isosceles trapezoid;

each said panel having a pair of inner diagonal chords rigidly connected between the mid point of said bottom chord to opposite ends of said top chord to divide said panel into three congruent isosceles triangles;

the ends of said bottom and top chords having apertures therein;

a first set of said panels being erected in a vertical plane with said bottom chords connected to each other in a row to form substantially a straight line and joined at said apertures by connecting elements;

a second set of panels, including at least one of said panels, erected in said vertical plane on top of and connected to said first set of panels;

the panels in said second set of panels having the top chords thereof mounted below the bottom chords thereof;

said top chords of both sets of panels being alternately interconnected to each other end-to-end with connecting elements placed in the apertures in the ends thereof to form a substantially straight line of chords along the neutral axis of said truss; and said bottom chords of said second set of panels connected with connecting elements placed in said apertures in the ends thereof to form substantially a straight line of chords and constituting a top chord of said truss.

2. A truss in accordance with claim 1 wherein reinforcing chords are attached to the top chord of said truss and to each other end-to-end.

3. A truss in accordance with claim 2 wherein reinforcing chords are attached to a bottom chord of said truss and to each other end-to-end.

4. A modular bridge comprising:

a plurality of trusses erected in vertical planes parallel to each other on opposite sides of said bridge;

each said truss formed from a plurality of interconnected congruent panels;

each said panel having parallel, top and bottom chords with said top chord being substantially half the length of said bottom chords;

each said panel having first and second outer diagonal chords of equal length with the ends thereof rigidly connected to ends of said top and bottom chords to form said panel into the shape of an isosceles trapezoid;

each said panel having a pair of inner diagonal chords rigidly connected between the mid point of said bottom chord to opposite ends of said to chord to divide said panel into three congruent isosceles triangles;

the ends of said bottom and top chords having apertures therein;

each said truss having a second set of panels, including at least one of said panels, erected on top of and connected to said first set of panels.

the panels in said second set of panels have the top chords thereof mounted below the bottom chords thereof;

said top chords of both set of panels being alternately interconnected to each other end-to-end with connecting elements placed in the apertures in the ends thereof to form a substantially straight line of chords along the neutral axis of said truss; and said bottom chords of said second set of panels connected with connecting elements placed in said apertures in the ends thereof to form substantially a straight line of chords and constituting a top chord of said truss.

5. A bridge in accordance with claim 4 wherein reinforcing chords are attached to the top chord of each said truss and to each other end-to-end.

6. A bridge in accordance with claim 5 wherein reinforcing chords are attached to a bottom chord of each said truss and to each other end-to-end.

* * * * *